United States Patent [19]

Stallard

[11] 4,322,085

[45] Mar. 30, 1982

[54] CIRCULAR CHESS GAME

[76] Inventor: Steven M. Stallard, 2632 Lindsay Ave., Apt. B2, Louisville, Ky. 40206

[21] Appl. No.: 152,109

[22] Filed: May 21, 1980

[51] Int. Cl.[3] ..... A63F 3/02

[52] U.S. Cl. ..... 273/261

[58] Field of Search ..... 273/261, 260; D21/24, D21/32

[56] References Cited

U.S. PATENT DOCUMENTS

| | | | |
|---|---|---|---|
| D. 22,686 | 8/1893 | Garside | D21/32 |
| D. 24,852 | 11/1895 | Cummings | 273/260 X |
| 611,758 | 10/1898 | Murphy | 273/261 |
| 1,400,520 | 12/1921 | Bugenhagen | 273/260 |
| 3,776,554 | 12/1973 | Capablanca et al. | 273/261 |
| 3,851,883 | 12/1974 | Hitchcock et al. | 273/261 |
| 3,917,273 | 11/1975 | Blakewood | 273/261 |

FOREIGN PATENT DOCUMENTS

| | | | |
|---|---|---|---|
| 141915 | 3/1931 | Switzerland | 273/260 |

*Primary Examiner*—Richard C. Pinkham
*Assistant Examiner*—Scott L. Brown
*Attorney, Agent, or Firm*—Richard L. Caslin

[57] ABSTRACT

A flat, two-dimensional circular chess game board, that is adapted for playing chess, is shown having a playing area of circular configuration that is divided into a plurality of alternate light and dark playing spaces by means of an inner circle having a pair of diametrical flaps at the East and West stations, and 8 radial files on the South side of the flaps, and 8 radial files on the North side of the flaps. The radial files of the circular playing area are further divided by a series of 5 concentric circular ranks which extend from the inner circle to the outer circular configuration. Moreover, there are 3 playing spaces extending radially outward from each East and West flap which connect the North and South playing areas. In a standard chessboard there are 64 playing spaces, while in this Circular Chessboard there is a total of 86 playing spaces.

8 Claims, 11 Drawing Figures

WHITE'S NOTATION

BLACK'S NOTATION

CIRCULAR CHESS GAME

BACKGROUND OF THE INVENTION

1. Field of the Invention

This invention relates to the design configuration of a circular board for a chess game.

2. Description of the Prior Art

A standard chessboard is the same as a checkerboard having four sides, but there have been many prior art patents which change the standard chessboard configuration into other shapes.

An early patent is Kass U.S. Pat. No. 3,359,003 having a checkers or chessboard in the shape of a rotatable globe or cylinder having a playing surface marked with 64 playing positions divided into the usual 8 ranks and the usual 8 files. Another form of this Kass invention is where the game board may be flat, with the 64 playing positions arranged in radial files and ranks disposed on concentric circles.

The Capablanca et al U.S. Pat. No. 3,776,554 shows a circular chessboard having 64 playing spaces arranged in circular fashion into 8 radial files and 8 concentric ranks of 8 spaces each and forming spirals composed of series of diagonally adjacent spaces of light color running from outermost to innermost rank wherein the surface has associated therewith discrete coded indicia individually for all of the spaces, having like indicia for each spiral from the outermost rank to the innermost rank.

The Hitchcock et al U.S. Pat. No. 3,851,883 describes a circular chessboard of multiple spiral configuration provided with a center space or island and intended for a predetermined number of players depending upon the structure of the board. The arrangement involves two spirals for two players, three spirals for three players etc., thus, the number of players determines the number of spirals required for the game board. By removing peripheral segments from the game board, the game may be rendered easier. The movements of the various pieces are generally similar to those of a standard chess game, except that certain ones move in curvilinear paths and pass through or across the center island.

The Blakewood U.S. Pat. No. 3,917,273 describes a multiple chess or checker game board having a flat board which can accommodate a plurality of sets of pieces controlled by opposing players having a playing area of circular configuration wherein there is included a plurality of chessboards of conventional pattern, each of which contains 8 discrete spaces of alternating color on a side providing 8 ranks and 8 files, and an additional file area providing an added checkered area separating said chessboards.

The Ball et al U.S. Pat. No. 4,019,740 describes a circular chessboard which has a playing area divided into playing spaces and respective similar armies of pieces which may be moved about the playing area by the players to capture opposing pieces. Each player is provided with one or more non-playing areas adapted to accommodate one of his playing pieces and with a marker adapted to be accommodated on a playing space, whereby either player can remove one of his playing pieces from the playing area and denote the playing space from which it was removed by positioning his marker on that playing space.

Design Pat. to Aiuppa U.S. Pat. No. Des. 226,321 shows a combined circular checker or chessboard having right angular ranks and files in combination with concentric circles for dividing the ranks and files into spaces.

Another appearance design Pat. to Aiuppa U.S. Pat. No. Des. 231,746 shows a circular checker and chessboard that's only a slight variation from the earlier Aiuppa appearance design patent.

The Squiers appearance U.S. Pat. No. Des. 236,515 shows a circular chessboard with radial ranks and concentric files having 64 spaces.

OBJECTS OF THE PRESENT INVENTION

The principal object of the present invention is to provide a novel circular chessboard which may be played the same as standard chess where the pieces move in the same manner and they attack the same and checkmate is achieved in the same manner except that the configuration of the board has been made circular so as to completely open up the game and permit much freer movement of the pieces.

A further object of the present invention is to provide a circular chessboard of the class described having 86 playing squares or spaces rather than the standard 64 spaces as in standard flat-boarded chess.

A further object of the present invention is to provide a circular chessboard of the class described having 8 radial files positioned in less than one half of the circular board which are continued on the other one half circle and separated by an inner circle and two diametrical flaps.

A further object of the present invention is to provide a circular chessboard of the class described having 5 arcuate ranks in one half of the circular board and they are separated from 5 similar arcuate ranks in the remaining one half of the circular board by the two diametrical flaps.

A further object of the present invention is to provide a circular chessboard of the class described where the board has an inner circle or island and an outer circle or periphery and the first rank is located adjacent the inner circle and the play originates from the first and second ranks and progresses outwardly to the outer circle or periphery where the piece may exit from the board and reenter the board at the opposite side of the board.

A still further object of the present invention is to provide a circular chessboard where the movement of the WHITE player is from the inner circle South to the outer circle and then the WHITE piece reenters the board at the North side of the outer circle and moves southward toward the inner circle, and the movement of the BLACK piece operates in an opposite manner starting from the first and second ranks North of the inner circle and moving northerly until it reaches the outer circle and leaves the board and reenters the board at the South portion of the board represented by the outer circle.

The principal object of the present invention is to provide a flat two-dimensional game board apparatus which can accommodate a plurality of chess pieces that are controlled by opposing players where the board has only one side which is an inner circle, excluding the flaps, as compared with a standard chessboard that has four sides that confine the game.

A further object of the present invention is to provide a circular chessboard of the class described that has a playing area of circular configuration that is divided into a plurality of playing spaces by means of an inner circle, a pair of diametrical East and West flaps with 8 radial flaps and 5 concentric ranks wherein there are 3 playing spaces extending radially outward from each East and West flap for connecting the North and South portions of the board together.

A further object of the present invention is to provide a circular chessboard of the class described wherein the playing spaces are of alternate light and dark colors and the KR1 space for the WHITE player is located adjacent the inner circle and the West flap, and the KR1 space for the BLACK player is located adjacent the inner circle and the East flap.

A further object of the present invention is to provide a circular chessboard of the class described wherein the outermost rank of playing spaces has a BAR along the outer edge of each light space and an INTERVAL along the outer edge of each dark space so that the BARS and INTERVALS serve as reference points for the pieces to alternately leave or reenter the board.

SUMMARY OF THE INVENTION

The present invention provides a circular chessboard having a playing area that is divided into a plurality of playing spaces by means of an inner circle having a pair of diametrical flaps at the East and West stations and 8 radial files on the South side of the flaps, and 8 radial files on the North side of the flaps, as well as a series of 5 concentric ranks which extend from the inner circle toward the outer circular configuration, and there are 3 playing spaces extending radially outward from each East and West flap so that there are a total of 86 playing spaces.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
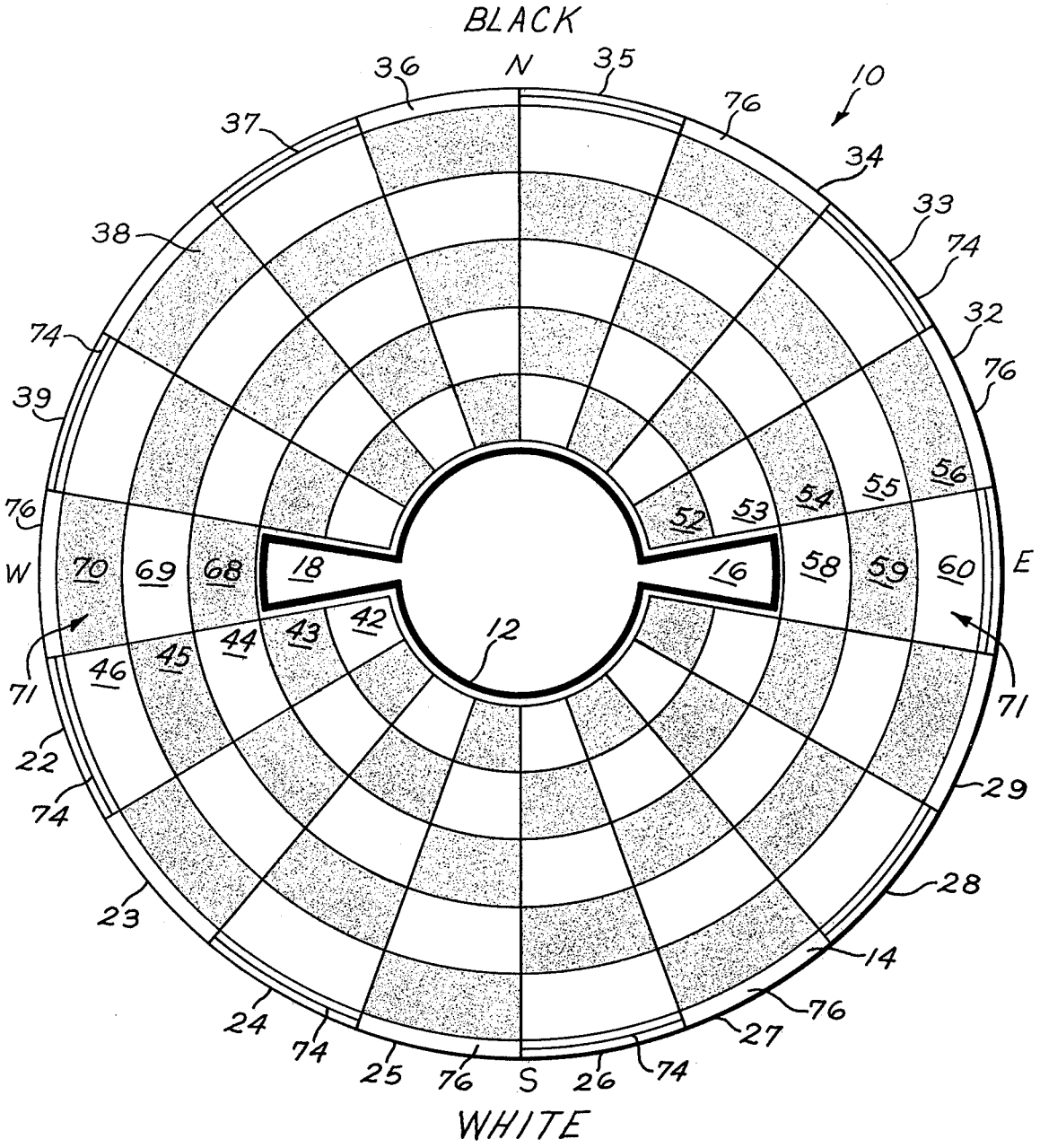
FIG. 1 is a top plan view of a circular chessboard for two players made in accordance with the present invention and as in standard chess the WHITE side is at the bottom or South side of the board, while the BLACK side of the board is at the top or North side of the board.

Turning now to a consideration of the drawings and in particular to the top plan view of FIG. 1 there is shown a flat two-dimensional circular chessboard 10 having an inner central circle or island 12 and an outer concentric circle 14. Thus, the playing area of this circular chessboard is all between the inner circle 12 and the outer circle 14. This circular chess game has many things in common with a standard chessboard that has 4 sides; namely, the WHITE side is always at the bottom or South side, and the BLACK side is always at the top or North side. For the purpose of explanation these 4 stations of the compass are listed N, E, S, and W. Notice that the inner circle 12 has 2 diametrical flaps; namely, an East flap 16 and a West flap 18. In standard chess there are 16 chessmen for each player. Thus, there are 16 light-colored and 16 dark-colored chessmen (not shown). The player with the light-colored pieces is known as WHITE, while the player with dark-colored pieces is known as BLACK. In standard chess the North-South or vertical rows are called "files" while the East-West or horizontal rows are called "ranks." Hence, a similar designation will be followed in describing the circular chessboard of the present invention. In standard chess there are 8 vertical files and 8 horizontal ranks for a total of 64 playing spaces.

In the present invention there are 8 radial files 22–29 located in the South half of the outer circle 14 beneath the 2 diametrical flaps 16 and 18. There are also 8 radial files 32–39 in the upper North half of the outer circle 14 and these North files are continuations of the 8 radial files in the South half of the outer circle 14 as can be appreciated by studying FIG. 1. Thus, radial file 32 is an extension of radial file 22 and radial file 33 is an extension of radial file 23 etc.

There are 5 arcuate ranks 42–46 in the South half of the board which are counted outwardly from the inner circle 12 and formed by concentric circles that have the geometric center of the board 10 as their center. In a similar manner there are 5 arcuate ranks 52–56 in the North half of the board counting outwardly from the inner circle 12 to the outer circle 14.

There are 3 WHITE flap spaces 58–60 that extend radially outwardly from the right hand or East flap 16, and there are 3 BLACK flap spaces 68–70 which extend radially outwardly from the left hand or West flap 18. These 6 flap spaces as a group may be identified as element 71, and they connect the North and South sides of the board.

When setting up the pieces in a standard chessboard, the WHITE player has a white square in the right hand corner of the first rank of the South side of the board. In setting up the circular chessboard 10 of the present invention, the WHITE player has a white square or space in the first file 22 and first rank 42 of the South side of the board. Accordingly, measured from that white or light playing space as the datum, all of the other playing spaces alternate in color.

Figure 2:
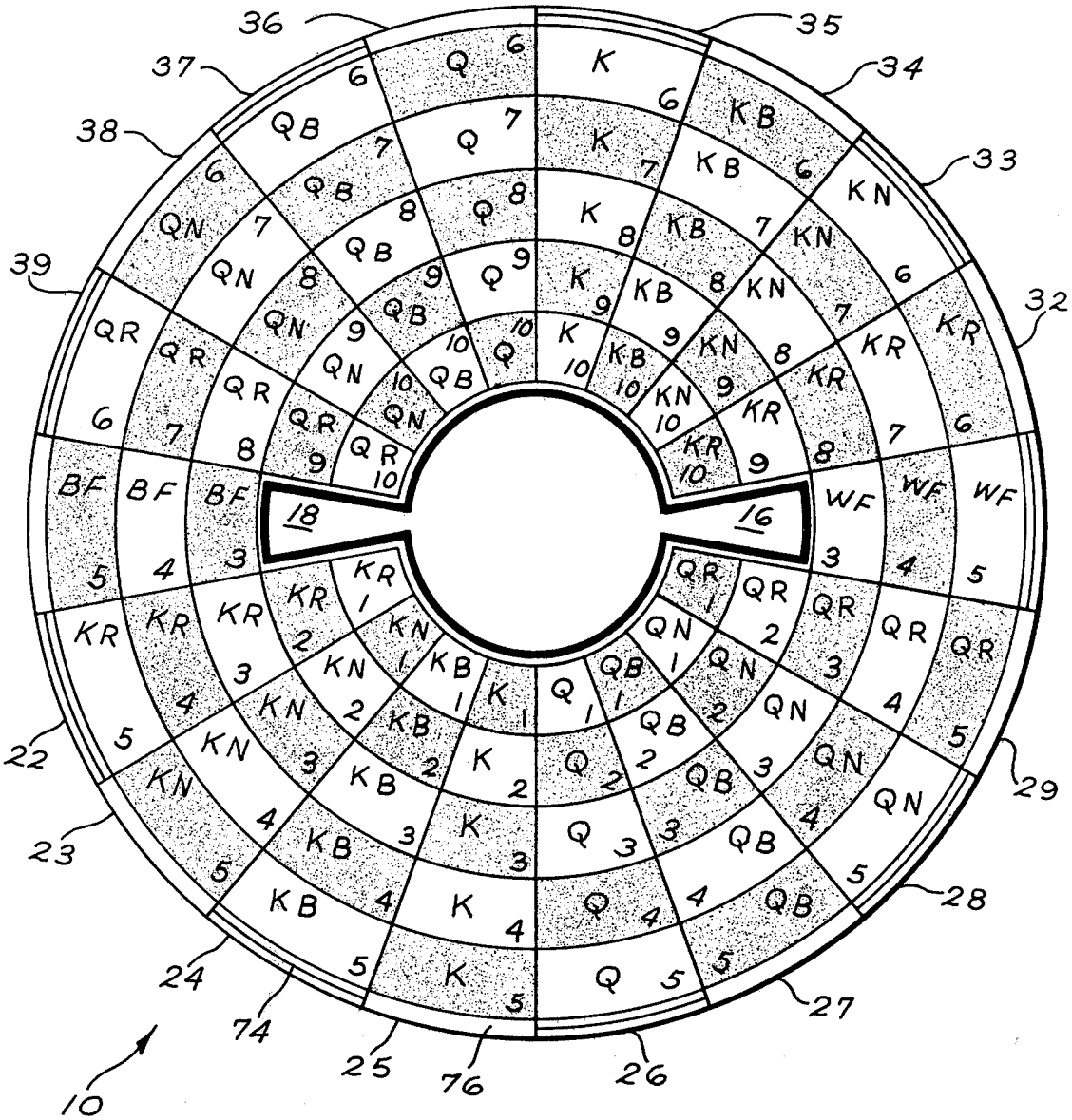
FIG. 2 is a plan view on a reduced scale similar to the view of FIG. 1 showing the notation for the WHITE player.

In standard chess there is a notation system which provides for the precise identification of all of the playing spaces for the ease of recording chess moves. This same chess notation system can be adopted in a modified form for the circular chessboard of the present invention. Thus, FIG. 2 shows the positions of the WHITE players. For example, the first WHITE rank 42 contains the following playing spaces counting left to right from the first file 22 to the last file 29: KR1, KN1, KB1, N1, Q1, QB1, QN1, and QR1. The 8 WHITE pawns are positioned in the second WHITE rank 43 and these spaces are identified as KR2, KN2, KB2, K2, Q2, QB2, QN2, and QR2.

Figure 11:
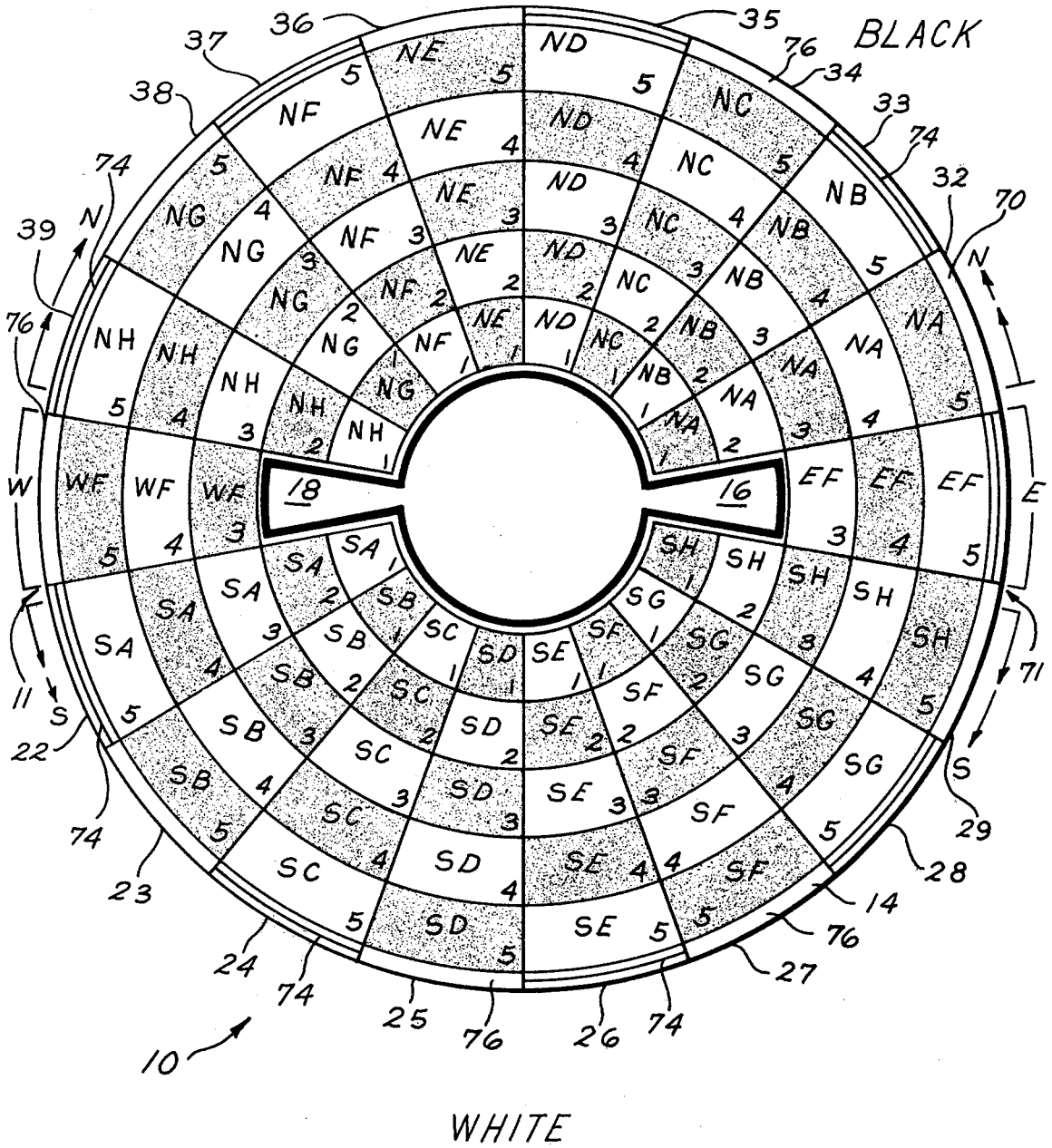
FIG. 11 is another plan view like FIG. 4 showing the newer algebraic notation in a modified form as it is applied to the present invention.

The other playing spaces of FIG. 2 have been marked with the notations for the WHITE player so that this will explain to those chess players who are skilled in this art of the nature of the playing area on which the WHITE player functions. It should be appreciated by those skilled in this art that the new algebraic notation system may also be used for this invention. Because we are in a transition period between the old and the algebraic systems, the old system has been employed in this invention, although FIG. 11 shows how the algebraic notation system may be employed. Notice that the arcuate ranks 1–5, as identified by numerals 42–46 respectively, are counted outwardly from the inner circle 12 to the outer circle 14. In an opposite relationship, the remaining arcuate ranks 6–10, as identified by numerals 56–52 respectively, are counted inwardly from the outer circle 14 to the inner circle 12. The last number of each notation represents the "rank" on which the square or playing space is located.

Figure 3:
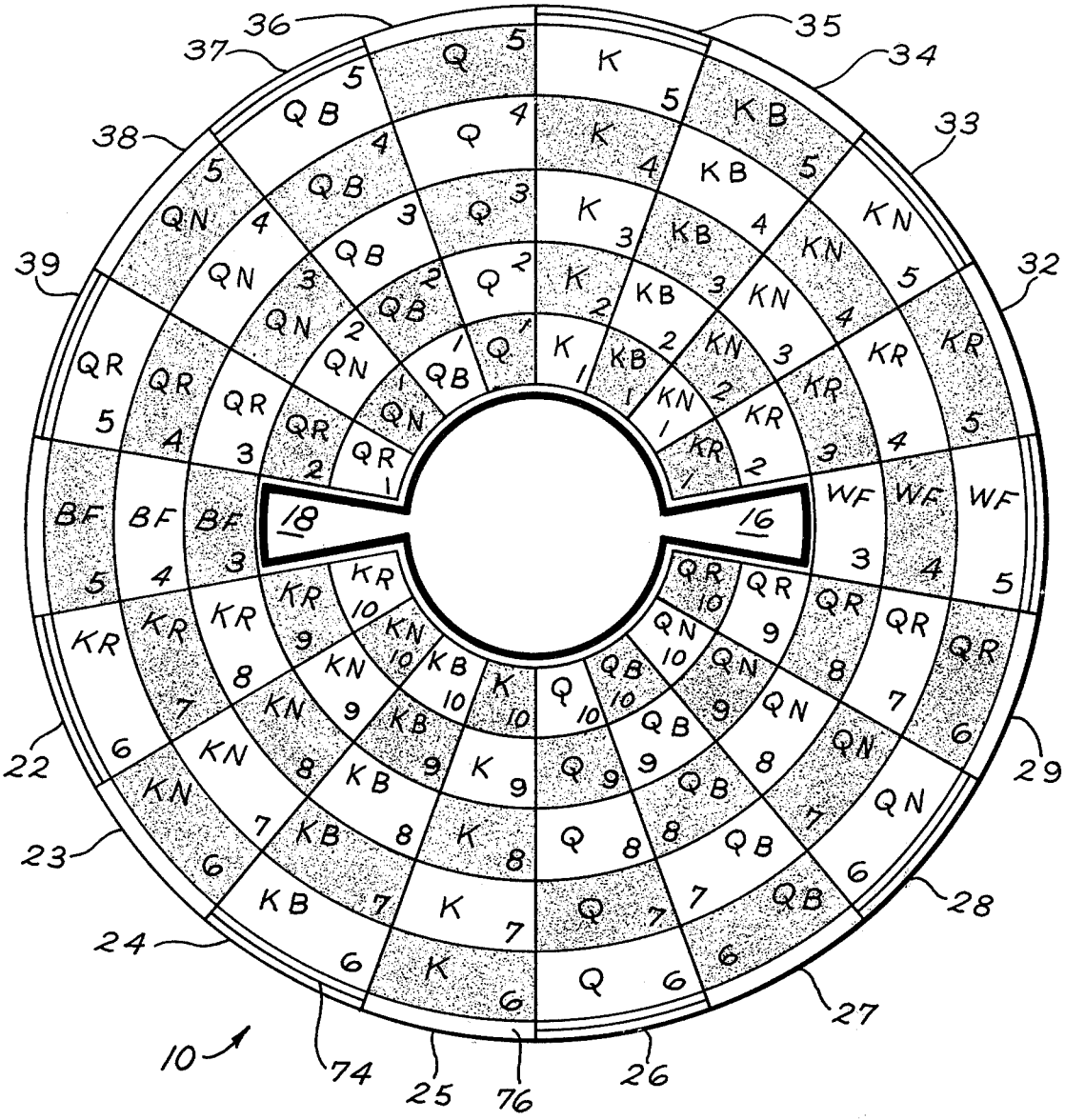
FIG. 3 is a plan view similar to that of FIG. 2 except that it shows the notation for the BLACK player.

FIG. 3 has been supplied with the notations for the BLACK player. First off, the 18 BLACK pieces are positioned in the playing spaces of the first and second ranks 52 and 53 respectively, so as to be in opposition to the WHITE players in the other first and second ranks 42 and 43 respectively. Notice that the first Black rank 52 corresponds to the teeth White rank 52.

The term Center Spaces refers to the 18 spaces that make up the first ranks 42 and 52 plus the innermost half of the two flap spaces 16 and 18 that complete this inner circle 12.

The term Pockets refers to the 32 spaces that are enclosed by the flaps of ranks 42, 43, 52 and 53. These playing spaces are the ones that are loaded with the playing pieces in preparation for starting the game.

The outer circle 14 is provided with a series of alternate bars 74 and intervals 76. A bar 74 is always associated with a white or light space while an interval is always associated with a black or dark space inside of it. The bars 74 and the intervals 76 are not spaces to be landed upon, but only reference points for leaving and reentering the board 10.

One rule of thumb from standard chess is that the Queen is positioned on its respective color to start out with. For example, the WHITE Queen is positioned on a white square or space. Also the BLACK Queen is positioned on a black square or space.

The following rules of standard chess will be repeated here because they are also followed in the practice of this circular chess game.

King can move in any direction, one square at a time. King cannot displace any of his own men, nor can he leap over them. King captures in the same way that he moves.

Figure 4:
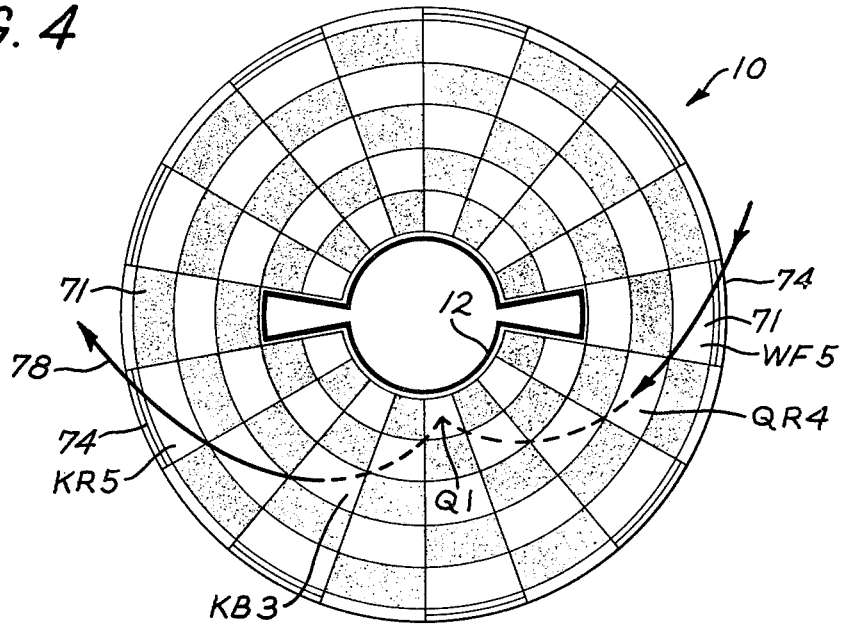
FIG. 4 is a plan view on a reduced scale of the circular chessboard of FIG. 1 showing the diagonal moves of the BISHOP (B) employing the BACKFIRE SYSTEM for determining the reentry path of the BISHOP back onto the board. For the sake of convenience, all diagrams are given in WHITE'S notation, FIG. 2.
Figure 10:
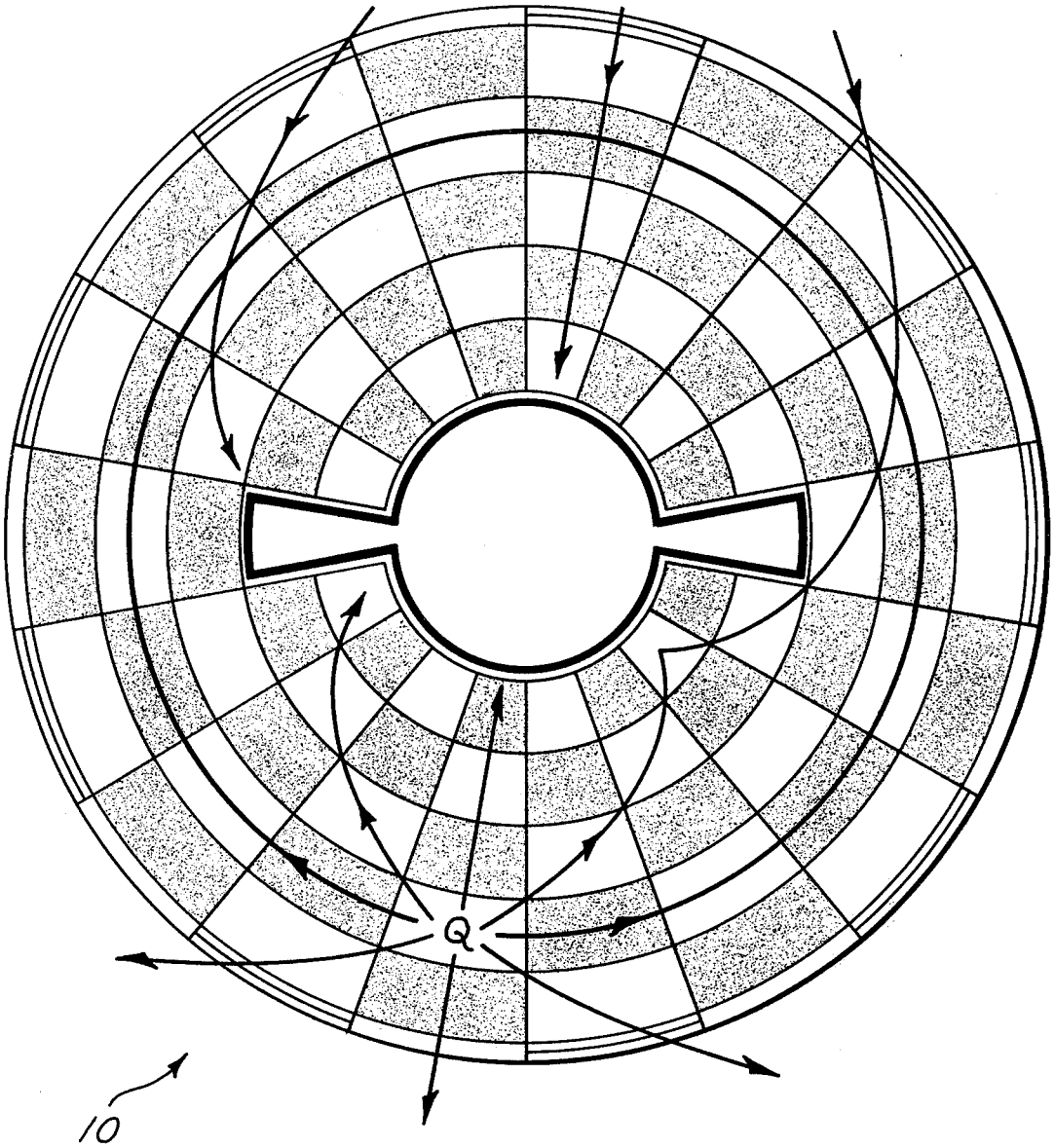
FIG. 10 is another plan view like FIG. 4 to show the three possible directional moves of the QUEEN (Q).

The Queen can move the whole length of one of the lines available to her, subject to impediments such as friendly pieces which block her path and hostile pieces which can be captured by her. Queen may move on a radial file, on a circular rank, or on a diagonal, as is illustrated in FIG. 10. The Queen combines the moves of the Bishop (FIGS. 4 and 5) and the Rook (FIG. 6). The Queen has the greatest powers of any piece on the chessboard.

The Rook can move circularly on ranks and radially on files, in one direction at a time, as is shown in FIG. 6. Rook is not quite as strong as the Queen. Rook cannot move diagonally nor can it displace or leap over friendly pieces.

The Bishop, like the Queen, can move and capture diagonally. Unlike the Queen and the Rook, the Bishop cannot move on ranks and files. The move can be in only one direction. See FIGS. 4 and 5. To determine the trajectory of the Bishop from the KB3 space of FIG. 4 to the other side of the board 10 moving in the clockwise direction 78, first draw an imaginary sighting line in the opposite direction of intended travel to a Center Space Q1. Then continue moving out on a diagonal line following the same colored spaces to the periphery of the board at the flap space WF5. This system has been labeled THE BACKFIRE SYSTEM for determining trajectory. The Bishop may cover any of the spaces along the diagonal lines drawn on FIG. 4 if no pieces are in the way. It should be noted that the Bishop does not move to space QR4 by bouncing off of the inside circle or island 12, but by leaving the board at the Bar 74 of space KR5 and reentering the board at the Bar 74 of space WF5. This BACKFIRE SYSTEM is a method whereby the Bishop's course is easily plotted, and not the actual spaces traversed. If the Bishop leaves the board on a Bar 74, it will reenter on a Bar. The reverse is also true. If the Bishop leaves the board on an Interval 76, it will return on an Interval.

Figure 5:
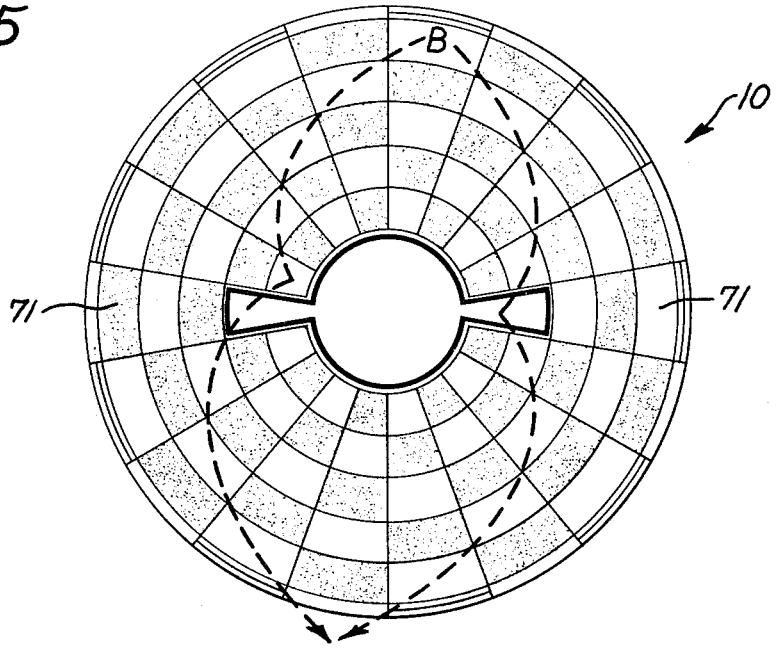
FIG. 5 is another plan view like FIG. 4 to show possible sighting lines of the BISHOP with relation to the East and West flaps, where the trajectory may be sighted through the flaps. However, the flaps may not be crossed in the course of a move.
Figure 6:
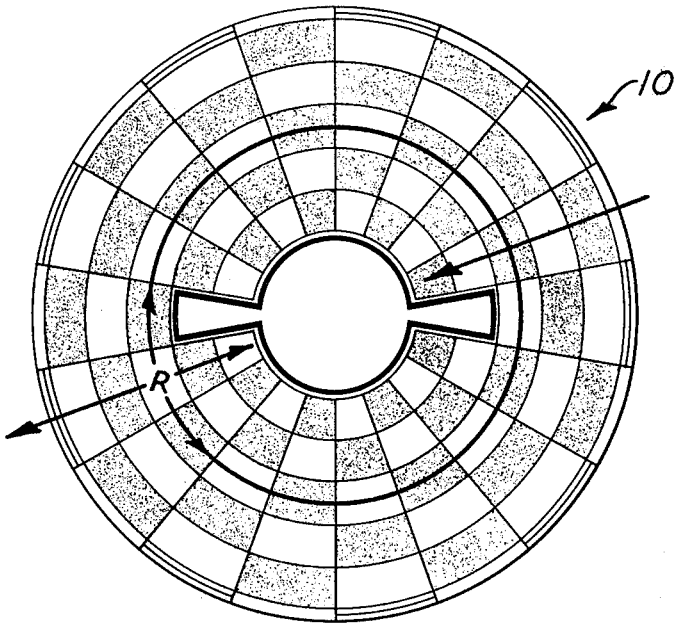
FIG. 6 is another plan view like FIG. 4 to show possible rank and file moves of the ROOK (R), but it cannot pass over an occupied space, or over a flap.

Now looking at FIG. 5, in order to hit a Center Space, it may be necessary to sight through a flap to obtain a true course for your piece. However, this is only for sighting. The flap may not be crossed in the course of a move.

Figure 7:
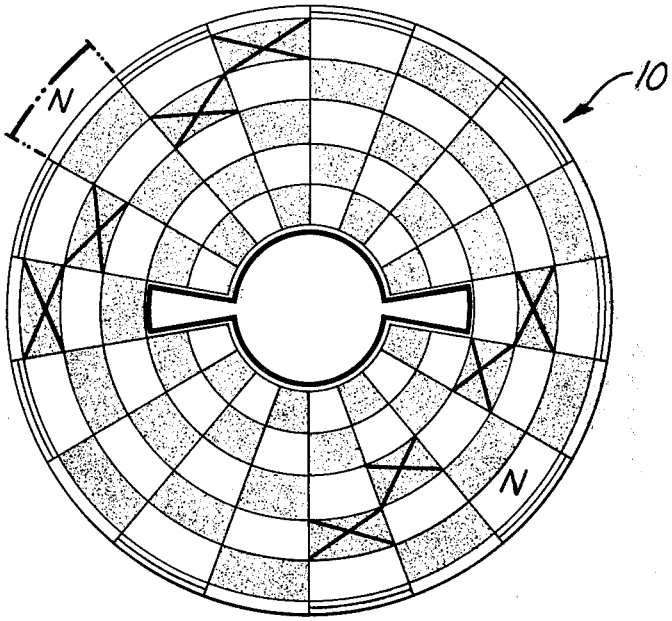
FIG. 7 is another plan view like FIG. 4 to show the L-shaped movement pattern of a KNIGHT (N) across the board.
Figure 8:
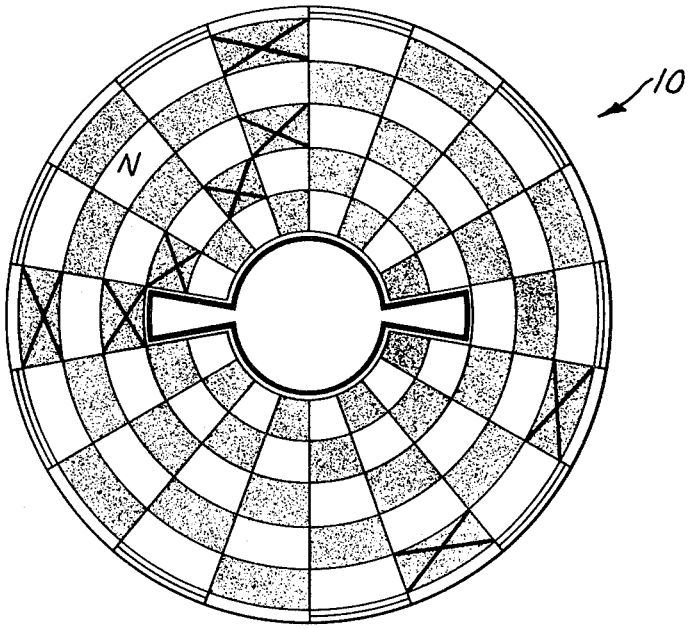
FIG. 8 is another plan view like FIG. 4 to show the L-shaped movement pattern of a KNIGHT (N) across the board, but starting from a different position.

The Knight can be described as the clown or the practical joker or the secret weapon of the chessboard. Knight can and does leap over all of the other forces, be they friendly or hostile. The Knight's moves are unrelated to the moves of the other pieces. The Knight's moves are always of the same length. Each Knight moves a combination of one square in one direction and two squares in a transverse direction, in other words, in an L-shaped path. Always one square and then two squares for a total of three squares, as is shown in FIGS. 7 and 8. The Knight can take pieces only on the terminal or final square. A Knight on KR1 can move to KB2 or KN3 or BF3, but it may not move to QR9 because a flap may not be crossed in the course of a move.

Figure 9:
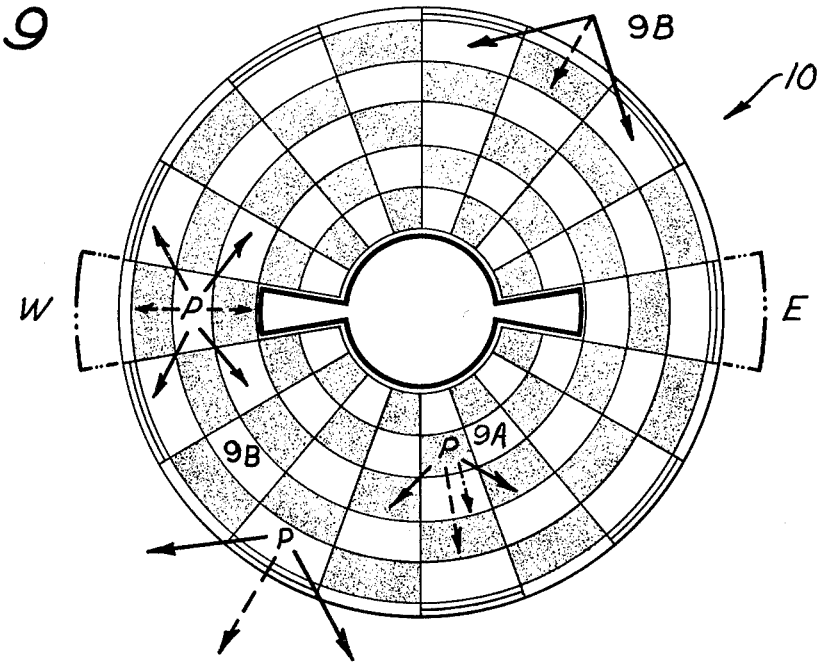
FIG. 9 is another plan view like FIG. 4 to show the possible moves of the PAWN (P).

The Pawn can move in only one direction; namely, forward, from the second rank toward the tenth rank. See FIG. 9A and B. One exception would be the diagram of FIG. 9C. Pawn captures in a manner different from the way in which it moves. WHITE Pawns always move from the inner circle 12 to the outer circle 14 and then it may come in on the opposite side of the board and move from the outer circle 14 to the inner circle 12 again. Pawn advances only one square at a time. On the Pawn's first move it may advance either one or two squares (FIG. 9A). On any subsequent move, the Pawn can only move one space. The Pawn captures the piece which is diagonally forward on adjoining squares.

Pawn moves like a miniature Rook, although it captures like a miniature Bishop. A Pawn on a Bar 74 will attack to another Bar when crossing the board, although it will move to an Interval 76. See FIG. 9B, for example. A Pawn on the flap space 71 has the option of attacking any of the squares shown in FIG. 9C, or generally may move either way on the flap spaces, toward or away from the flap. The Pawn is considered the weakest piece on the board, but it has remarkable powers. A Pawn advancing to the tenth rank may be removed from the board and replaced with any piece that you want except the King. The En Passant rule applies in the game of this invention, in the same manner as in conventional chess.

A game of chess is won by attacking the hostile King (K) in such a way that no matter what the opponent does his King cannot escape capture. When either King is attacked, he is said to be in check. When the attack is of the kind against which there is no defense, the King is said to be checkmated, and the game is over. The King is never actually captured. There are two ways to win the game. First, by checkmating the opponent's King, and the other is by achieving so great a superiority of force that the opponent resigns.

In standard four-sided chess, the playing board is confined to the four sides that encase the game. The playing board in circular chess has only one side; namely, the inside circle 12 excluding the two flaps 16 and 18. This completely opens up the game of circular chess and allows for much freer movement.

The notation in circular chess is the same as in square-boarded chess except for the addition of 2 spaces in each file 22–29 when considered in combination with files 32–39 respectively, and the 3 spaces radially outward of each of the 2 flaps 16 and 18 respectively.

The Rook on KR3 of FIG. 6 may go to any space on the King Rook file 22, but is cannot pass over an occupied space. The Rook on KR3 may travel the file 22 and leave the file at the Bar 74 and reenter the board at the interval 76 of file 32, as is best seen in FIG. 6. The Rook can cover any of the spaces on either the third or the eighth rank.

In order to avert "holding patterns," the Queen, Rook and Bishop may not round the board and re-settle on the same space from which the move began. The Knight is the only piece that can jump over another piece, but it may not cross a flap 16 or 18. A Knight on a black space will always land on a white space. A WHITE Knight on the fifth rank 46 may be imagined as being on a space directly across and outside of the playing board. In this manner, it is easy to see the spaces that are accessible to the Knight. Thus, if the WHITE Knight were on space QN5, it may move to space Q4 or QB3 or QR3 or WF4. Or it may reenter on the other side of the board and move to space QB7 or Q6 or QR7 or BF5.

As to a Pawn, imagine there is a Pawn at space QB5. It may attack either space QN6 or space Q6, or it may move to QB6. Notice that the Pawn is on a Bar 74. It can only attack to another Bar. The same is true of a Pawn on an Interval 76. It will always attack to another Interval 76. Pawns may be promoted in the same manner as in standard chess, although they must travel 2 spaces further to reach their last rank.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A flat, two-dimensional circular chess game board apparatus that is adapted for playing chess and accommodates a plurality of standard chess pieces controlled by two opposing players comprising:

a. a playing area of circular configuration that is divided first by forming a non-playing inner central circle having a pair of non-playing diametrical flaps or barriers at the East and West stations of the circle, and further divided by means of a plurality of 8 radial files on the South side of the flaps or barriers, and by means of a like plurality of 8 radial files on the North side of the flaps or barriers;

b. and the radial files of the circular playing area being further divided by a series of concentric ranks which extend from the inner circle to the outer circular configuration;

c. and at least two playing spaces extending radially outward from each East and West flap or barrier, so the playing area is divided into a plurality of playing spaces of alternate light and dark spaces;

d. and each diametrical flap or barrier extending radially in length equal to the two innermost concentric ranks whereby the chess pieces would be first loaded onto the playing spaces in the two innermost concentric ranks below and above the non-playing diametrical flaps or barriers, and separated thereby.

2. The circular chess game board apparatus of claim 1 wherein there are 5 concentric ranks between the inner central circle and the outer circular configuration, and 3 playing spaces extending radially outward from each East and West flap for a total of 86 playing spaces.

3. The circular chess game board apparatus of claim 2 wherein the three playing spaces to the right side of the East flap are WHITE flap spaces three, four and five counting from the East flap to the outer circular configuration, while the three playing spaces to the left side of the West flap are BLACK flap spaces three, four and five counting from the West flap to the outer circular configuration.

4. The circular chess game board apparatus of claim 1 wherein a chess player that is positioned at the South side of the board would be considered as a WHITE player, and the opposite player that is positioned at the North side of the board would be considered as a BLACK player, and a light space for the WHITE player is located in the innermost circle and adjacent the West flap, while a dark space for the BLACK player is located in the innermost circle and adjacent the East flap.

5. The circular chess game board apparatus of claims 1, 2 or 4 wherein the outermost rank of playing spaces that is adjacent the outer circular configuration has a BAR along the outer edge of each light space and an INTERVAL along the outer edge of each dark space, there being in the outer circular configuration for each pair of diametrical radial files an INTERVAL at one end and a BAR at the opposite end, whereby said BARS and INTERVALS serve as reference points for the chess pieces to alternately leave the board at one side of the board and encircle the board and reenter the board at the opposite side of the board.

6. The circular chess game board apparatus as recited in claim 4 wherein the WHITE player has 5 ranks on the South side of the board counting from the inner circle toward the outer circular configuration, as well as 5 more ranks on the North side of the board counting from the outer circular configuration toward the inner circle.

7. The circular chess game board apparatus as recited in claim 4 wherein the WHITE player has 5 ranks on the South side of the board counting from the inner circle toward the outer circular configuration, as well as 5 more ranks on the North side of the board counting from the outer circular configuration toward the inner circle, and the BLACK player has 5 ranks on the North side of the board counting from the inner circle toward the outer circular configuration, as well as 5 more ranks on the South side of the board counting from the outer circular configuration toward the inner circle.

8. The circular chess game board apparatus as recited in claim 4 wherein the WHITE player has 5 ranks on the South side of the board counting from the inner circle toward the outer circular configuration, as well as 5 more ranks on the North side of the board counting from the outer circular configuration toward the inner circle, and the BLACK player has 5 ranks on the North side of the board counting from the inner circle toward the outer circular configuration, as well as 5 more ranks on the South side of the board counting from the outer circular configuration toward the inner circle, the outermost rank of playing spaces that is adjacent the outer circular configuration has a BAR along the outer edge of each light space and an INTERVAL along the outer edge of each dark space, whereby said BARS and INTERVALS serve as reference points for the chess pieces to alternately leave or reenter the board from the fifth rank to the sixth rank.

* * * * *